US005289145A

United States Patent [19]

Schedele

[11] Patent Number: 5,289,145

[45] Date of Patent: Feb. 22, 1994

[54] ELECTROMAGNETIC RELAY AND A METHOD FOR ITS PRODUCTION

[75] Inventor: Helmut Schedele, Diessen, Fed. Rep. of Germany

[73] Assignee: Siemens Aktiengesellschaft, Munich

[21] Appl. No.: 934,523

[22] PCT Filed: Nov. 19, 1990

[86] PCT No.: PCT/DE90/00890

§ 371 Date: Oct. 9, 1992

§ 102(e) Date: Oct. 9, 1992

[87] PCT Pub. No.: WO91/15866

PCT Pub. Date: Oct. 17, 1991

[30] Foreign Application Priority Data

Apr. 9, 1990 [DE] Fed. Rep. of Germany ..... 4011402

[51] Int. Cl.[5] ..... H01H 51/22

[52] U.S. Cl. ..... 335/78; 335/128

[58] Field of Search ..... 335/78-86, 335/104, 124, 130, 128

[56] References Cited

U.S. PATENT DOCUMENTS

| | | | |
|---|---|---|---|
| 4,321,569 | 3/1982 | Bernier | 335/128 |
| 4,486,727 | 12/1984 | Freeman et al. | 335/106 |
| 4,684,909 | 8/1987 | Dittmann | 335/128 |
| 4,914,411 | 4/1990 | Hikita et al. | 335/128 |
| 4,993,787 | 2/1991 | Tanaka et al. | 335/80 |
| 5,191,306 | 5/1993 | Kaji et al. | 335/78 |

FOREIGN PATENT DOCUMENTS

| | | |
|---|---|---|
| 0012696 | 6/1980 | European Pat. Off. . |
| 0075393 | 3/1983 | European Pat. Off. . |
| 8323131 | 5/1985 | Fed. Rep. of Germany . |
| 3835105 | 8/1989 | Fed. Rep. of Germany . |

*Primary Examiner*—Lincoln Donovan

[57] ABSTRACT

An electromagnetic system having a coil (8), a yoke (10) and an armature (11) is arranged in the upper region of the cap in the relay having a housing cap (1) which is closed at the top, while a contact system (5, 6, 7) is mounted in the lower region in the vicinity of the connection side of the relay. Coil connecting elements (20) are embedded in each case in one side wall of the cap (1), for the connection of the coil winding, in such a manner that their ends open on the top of the cap in each case in a depression (18) which is open to the exterior. During the assembly of the magnet system, winding supporting elements (15), which are provided in each case on the coil former, are inserted into these depressions. The ends of the winding supporting elements (15) and of the coil connecting elements (20) are then be electrically conductively connected from the exterior by soldering or using a conductive adhesive. This results in a space-saving connection, which is nevertheless insulated with respect to the ferromagnetic parts of the magnetic system and the contact elements, between the winding ends of the coil (8) and the corresponding connecting pins (20a) on the bottom of the relay.

8 Claims, 2 Drawing Sheets

ELECTROMAGNETIC RELAY AND A METHOD FOR ITS PRODUCTION

BACKGROUND OF THE INVENTION

1. Field of the Invention

The invention relates to an electromagnetic relay having the following features:

a housing has a cap with an essentially closed top, closed side walls and an open bottom, which can be closed by a bottom part.

arranged in the housing are a contact system, with contact connecting elements which are guided out of the housing, and a magnet system whose coil is located adjacent to the closed top of the cap, and the winding ends of the coil are connected in each case to supporting elements, which are anchored in a coil former and, for their part, are electrically conductively connected to coil connecting elements which are guided out through the bottom.

In addition, the invention relates to a production method for such a relay.

2. Description of the Related Art

A relay having the above-described construction is disclosed, for example, by German published application 38 35 105. A narrow construction is achieved by the disclosed arrangement of the coil above the contact system in the closed upper region of the housing. As a result of the arrangement of the contact elements in the vicinity of the connection side in the lower part of the housing, short electrical connections are also ensured between the contacts and the associated connecting pins, which not only permits a saving in material and manufacturing steps, but also provides advantages with respect to heat dissipation and the insulation between the contact elements and the magnet system. This structural shape is therefore preferably used for heavy-current and mains relays.

As a result of the arrangement of the coil in the upper region of the housing, it is, however, necessary to guide the coil connecting elements via a relatively long path up to the connection side of the relay, it being necessary, however, to ensure the insulation to the ferromagnetic circuit parts of the magnet system and to the contact elements. Especially when the relay is used at relatively high voltages, this insulation requires a notinconsiderable space in the housing, either in the form of corresponding projections of the coil former or in the form of additional insulating parts.

SUMMARY OF THE INVENTION

The object of the invention is to specify a relay of the type mentioned initially and a production method for this relay, in which a simple and space-saving connection of the winding ends of the coil to the connection side of the relay is made possible while retaining the basic construction. In particular, it is intended in this case to ensure the insulation between the coil connecting elements and the magnetic circuit, as well as the contact elements, without any additional space requirements.

In order to achieve this object, a relay according to the invention has the following additional features:

the coil connecting elements are guided in insulated fashion in each case in a side wall of the cap, from the bottom as far as the region of the top of the cap, and open in a depression of the cap top, which is open outwards, the supporting elements of the coil former, which are electrically connected to the coil, are guided in insertion openings with respect to the cap top and likewise open in each case in one of the depressions, and in each depression, the respective end of a supporting element is conductively connected to the end of a coil connecting element.

In the relay according to the invention, the coil connecting elements are thus guided in an insulated manner directly in the wall of the cap, preferably by being embedded in the side wall. In consequence, within the housing space, there is no need for space for these coil connecting elements themselves nor for additional insulating walls. The space requirement is thus determined just by the extent of the magnet system and of the contact system.

The conductive connection between the ends of the respective supporting element and of the associated coil connecting element can basically be produced in different ways using standard methods. Welded connections or soldered connections come into consideration in this case, if the structure can be designed such that the ends to be connected are accessible for welding electrodes or for soldering devices, and, if necessary, the resistance to the soldering temperature is ensured in the vicinity of the soldering point. However, a connection by means of a conductive adhesive is particularly advantageous, which can be incorporated into the respective depression and sets at a relatively low temperature. In order to ensure the insulation of the connecting point to the exterior, an insulating material layer, which closes off the depression to the exterior, is preferably applied to the connecting point or to the conductive adhesive.

A preferred method for producing the relay comprises the following steps:

the cap is formed with the coil connecting elements embedded in at least one side wall, with depressions on the cap top in the region of the ends of the coil connecting elements and with insertion openings in the region of the depressions, the magnet system and the contact system are inserted into the open cap, supporting elements embedded in the coil former being inserted with free ends into the insertion openings in the cap, and in each case one supporting element is conductively connected to one coil connecting element in the depressions on the cap top.

If it is intended to close the housing off in a waterproof manner, it is advantageous, before producing the conductive connection in the depressions, to seal the bottom of the cap with potting compound, it being possible to use the insertion openings in the cap as ventilation holes until the potting compound sets. The supporting elements and the coil connecting elements can in each case be conductively connected, and the insertion openings at the same time closed in a sealed manner, by the insertion of conductive adhesive into the depressions. These depressions can then be additionally sealed, and the conductive connections insulated to the exterior, by the application of insulating material to the conductive connection in the depressions.

BRIEF DESCRIPTION OF THE DRAWINGS

The invention is explained in more detail in the following text, making use of exemplary embodiments in conjunction with the drawing, in which.

DETAILED DESCRIPTION OF THE PREFERRED EMBODIMENTS

Figure 1:
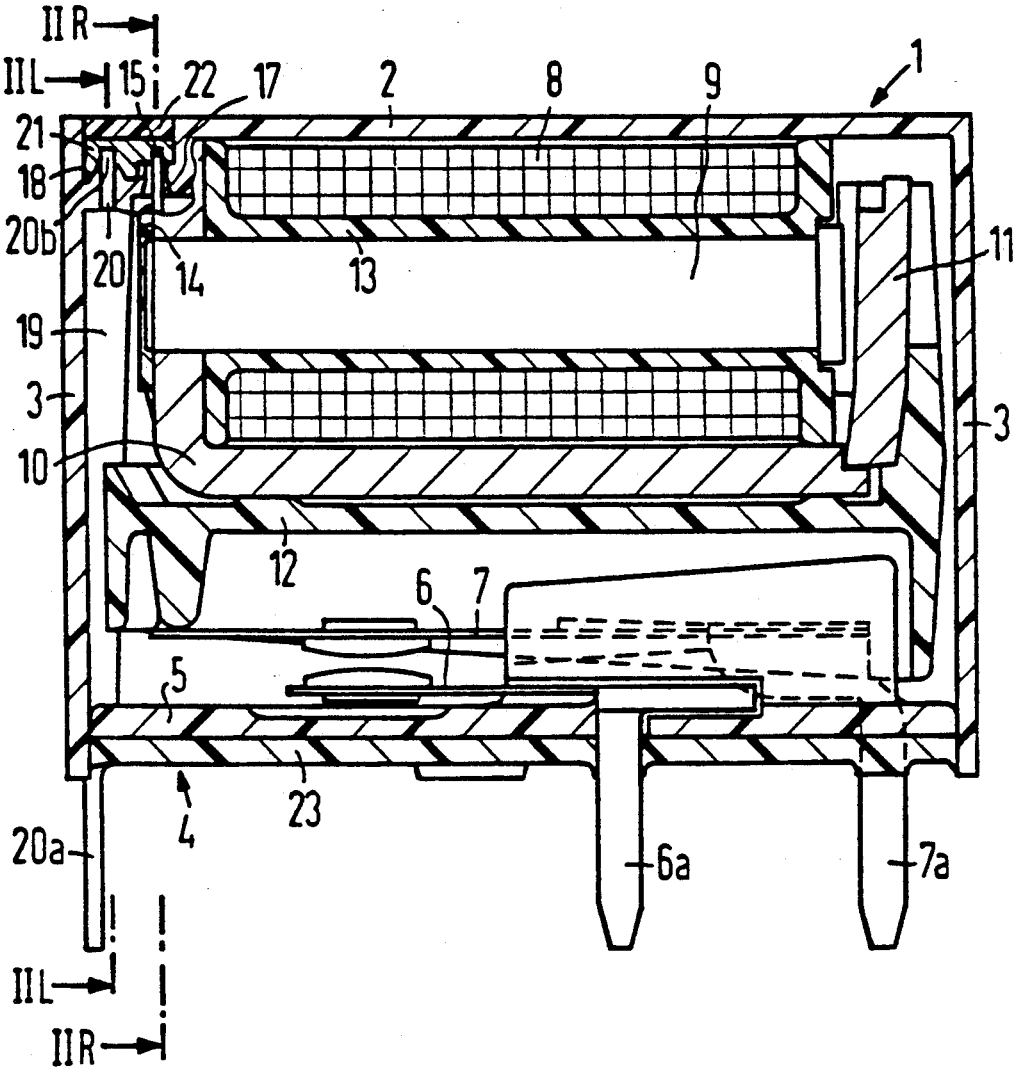
FIGS. 1 and 2 show a relay designed according to the invention in two sectional views, the left half of FIG. 2 showing a section IIL—IIL and the right half a section IIR—IIR from FIG. 1.
Figure 2:
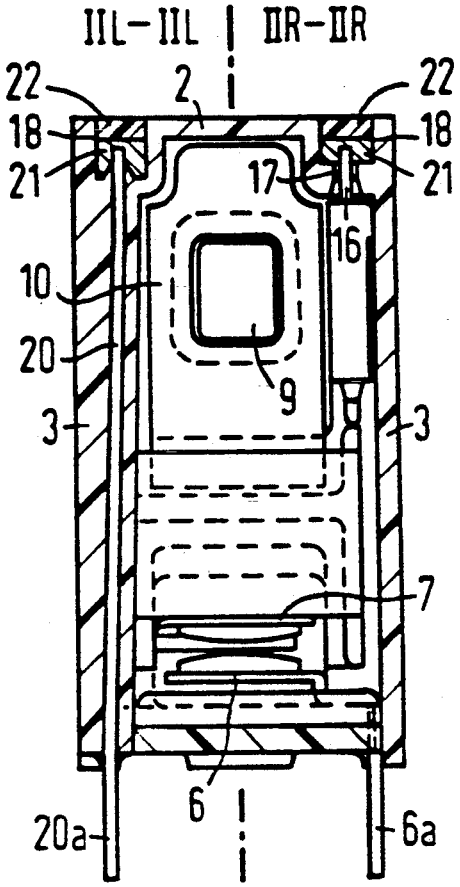
Figure 3:
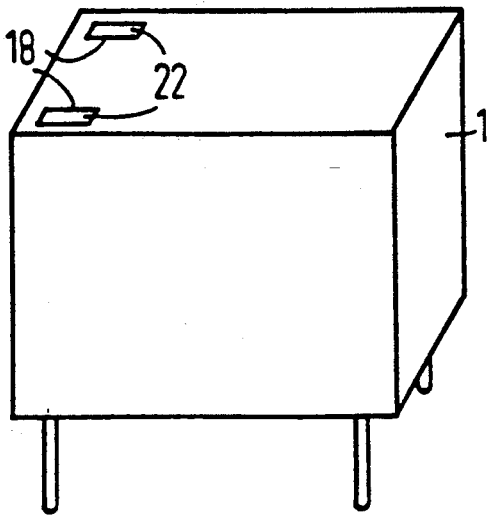
FIG. 3 shows a completely assembled relay in a perspective view.

The relay shown in FIGS. 1 to 3 has a housing which consists of a cap 1 having a closed top 2 and side walls 3, which are closed all round, and a contact support 5, which is inserted as a base into the open bottom 4 of the cap 1. Contact elements 6 and 7, which are mounted on the contact support 5, are mounted with their connecting elements 6*a* and 7*a* in the lower region of the housing, adjacent to the bottom. A magnet system, having a coil winding 8, a core 9, a yoke 10 and an armature 11, is arranged in the top region, adjacent to the closed top 2 of the cap, the armature operating the contact element 7 via an operating element 12. The construction and operation of the relay beyond this are intrinsically not a subject matter of this application and are therefore also not described in detail.

The coil winding 8 is seated on a coil former 13, in whose flange 14 two wire-shaped supporting elements 15 and 16 are anchored for winding and contacting the ends of the windings. These supporting elements 15 and 16 are guided with their free ends in each case through an insertion opening 17 into one of two depressions 18 on the top of the cap 1. These depressions 18 are formed in the top 2 of the cap and are initially open outwards, but are connected to the housing interior only via the insertion opening 17.

In addition, two coil connecting elements 20, each of which has a connecting pin 20*a*, which is guided out towards the bottom, and a connecting end 20*b*, which opens in each case into a depression 18 on the cap top, are embedded in one of the side walls 3 or in rib-like thickenings 19 in two corners of the side wall.

The depressions 18 are filled from the exterior with conductive adhesive 21 which in each case electrically conductively connects the supporting elements 15 and the coil connecting elements 20. An insulating material layer 22, which closes off and insulates the housing at the top, is applied over the conductive adhesive 21.

During assembly of the relay, the magnet system is initially inserted into the cap 1 and is mounted, therein the supporting elements 15 being inserted through the insertion openings 17. The housing is closed off at the bottom by the use of the contact system with the support 5. The housing is sealed by the application of a layer of potting compound 23, the insertion openings 17 acting as ventilation holes which permit pressure equalization while the potting compound 23 is setting. The conductive adhesive 21 is thereafter inserted into the depressions 18, the depressions then being closed off to the exterior by the insertion of the insulating material layer 22.

FIG. 3 shows a complete relay in a perspective view. The depressions 18, in which contact has been made with the coil connections in the manner previously described, and which are provided in the top and are sealed with the insulating material layer 22, can be seen on the cap 1.

Although other modifications and changes may be suggested by those skilled in the art, it is the intention of the inventor to embody within the patent warranted hereon all changes and modifications as reasonably and properly come within the scope of his contribution to the art.

I claim:

1. An electromagnetic relay, comprising:

a housing including a cap with a substantially closed top, closed side walls and an open bottom, said housing including a bottom part mounted to close said open bottom of said cap, a contact system in said housing and having contact connecting elements guided out of said housing, a magnet system having a coil located adjacent to the closed top of said cap, supporting elements connected to winding ends of said coil a coil former in which said supporting elements are anchored coil connecting elements electrically connected to said supporting elements, said coil connecting elements being guided in each case in insulated fashion in said closed side walls of said cap from the bottom as far as the region of the top of said cap, and extending into a depression in the top of said cap which is open outwards, said supporting elements of said coil former being guided in insertion openings with respect to the top of said cap and likewise open in each case in one of said depressions, and a conductive connection in each of said depressions between the respective end of said supporting elements and an end of said coil connecting element.

2. The relay as claimed in claim 1, wherein said coil connecting elements are in each case embedded in said side walls of said cap.

3. The relay as claimed in claim 1, wherein said conductive connection between the ends of said respective supporting element and of said coil connecting element is a conductive adhesive which at least partially fills said depression.

4. The relay as claimed in claim 1, further comprising:

a layer of insulating material sealing said depressions, said layer of insulating material covering said conductive connection between the supporting element (15) and the coil connecting element.

5. A method for producing a relay, having the following steps:

forming a cap with coil connecting elements embedded in at least one side wall, with depressions on a top of the cap in a region of ends of the coil connecting elements and with insertion openings in a region of the depressions, inserting a magnet system and a contact system into the cap, inserting supporting elements embedded in the coil former with free ends into the insertion openings n the cap, and conductively connecting in each case one supporting element to one coil connecting element in the depressions on the top of the cap.

6. The method as claimed in claim 5, further comprising the step of:

before said step of conductively connecting in the depressions, sealing the bottom of the cap with potting compound, the insertion openings in the cap being used as ventilation holes until the potting compound sets.

7. The method as claimed in claim 5, wherein said step of conductively connecting the supporting elements and the coil connecting elements includes insertion of conductive adhesive into the depressions, which also closes the inserting openings in a sealed manner.

8. The method as claimed in claim 5, further comprising the step of:

closing off the depressions at the top by the application of an insulating material layer to the conductive connections.

* * * * *